United States Patent [19]

Lamont et al.

[11] Patent Number: 4,934,419

[45] Date of Patent: Jun. 19, 1990

[54] FLEET DATA MONITORING SYSTEM

[75] Inventors: Iain A. J. Lamont, Billington; Stuart D. Finch, Wiltshire, both of England

[73] Assignee: Analytical Instruments Limited, Cambridge, United Kingdom

[21] Appl. No.: 277,805

[22] Filed: Nov. 30, 1988

[51] Int. Cl.[5] ..... B65B 1/30

[52] U.S. Cl. ..... 141/94; 141/83; 141/311 R; 141/98

[58] Field of Search ..... 141/940, 95, 83, 311, 141/360, 351, 346, 98; 350/96.23; 222/2

[56] References Cited

U.S. PATENT DOCUMENTS

| | | | |
|---|---|---|---|
| 2,675,943 | 4/1954 | Daley et al. | 141/94 |
| 4,469,149 | 9/1984 | Walkey et al. | 141/94 |
| 4,479,702 | 10/1984 | Pryor et al. | 350/96.23 |
| 4,723,831 | 2/1988 | Johnson et al. | 350/96.23 |

FOREIGN PATENT DOCUMENTS

| | | | |
|---|---|---|---|
| 3438939 | 5/1986 | Fed. Rep. of Germany | 141/94 |
| 2502134 | 9/1982 | France | 141/94 |

*Primary Examiner*—Henry J. Recla
*Assistant Examiner*—Edward C. Donovan
*Attorney, Agent, or Firm*—Anthony J. Casella; Gerald E. Hespos

[57] ABSTRACT

A fuel management system for use in the operation of a fleet of commercial vehicles, comprising a fuel supply means comprising a fuel pump connected to a fuel dispensing nozzle by way of a flexible fuel delivery hose. A fuel management system is coupled to the fuel pump for controlling the amount of fuel dispensed via the nozzle. One end of a fibre optic is carried by the pump nozzle for receiving information from a radiation transmitter on any of said commercial vehicles when the pump nozzle is inserted into the fuel entry port of that vehicle, the other end of the fibre optic being positioned to supply the information to the fuel management system. The fibre optic is run from the top of the nozzle, through a special fitting into the interior of the hose, the fibre optic then running the length of the delivery hose, surrounded by the fuel product, until it reaches the region of the fuel pump, where it emerges from the hose via a gland and runs on to the fuel management system.

7 Claims, 2 Drawing Sheets

FLEET DATA MONITORING SYSTEM

The present invention is concerned with a system for monitoring data in connection with the operation of a fleet of commercial vehicles.

For efficient operation of a fleet of commercial vehicles it is important that details of fuel used, distance travelled and diagnostic information is available for each vehicle on a regular basis.

Most operators of large fleets of vehicles have on-site fuelling facilities. These require identification of a valid vehicle before fuelling can take place, and allow for entry of other details such as odometer information. Using traditional systems, this information relies on manual input from the fueller of the vehicle and could be incorrect.

It is also possible that other information is available in the form of on-board diagnostics. Using traditional techniques, this information has only been available by manually reading instruments in the cab or by plugging in a diagnostic facility at a service bay.

In one system which has already been proposed for monitoring the amount of fuel dispensed from a delivery conduit to a fuel tank in a vehicle, a data-providing means is arranged to be associated with the circumference of a tubular entry port leading to the vehicle fuel tank. The data-providing means supplies data relating to that tank and the associated vehicle. The delivery conduit has a nozzle which is adapted to be received into the tubular entry port for delivering fuel to the vehicle tank. The part of the nozzle which is introduced into the entry port carries a data reader which is adapted to read data from the data-carrying means when the nozzle is being inserted into the entry port.

The latter system has the disadvantage that the data-providing means is necessarily associated with the tank entry port itself. For example, it can be disposed wholly around the inner or outer circumference of the tubular entry port. As a result, the data reader has to be located on or in that part of the nozzle which is introduced into the entry port. It is therefore particularly susceptible to damage during the repeated introduction and removal of the nozzle.

In order to overcome this latter problem, it is also known for data to be transmitted from the vehicle to a detector on the nozzle end of a fuel delivery conduit by means of an infra-red signal generated by an infra-red emitter disposed near to but not directly associated with the fuel entry port itself. Thus, the infra-red emitter is disposed sufficiently close to the fuel entry port such that, when the nozzle is inserted into the entry port an infra-red detector on the nozzle lies automatically in a position in which it will pick up infra-red radiation transmitted by the infra-red emitter.

In the latter known system, the infra-red detector has transmitted signals back to a fuel management system electronically, either by way of hard wiring or radio link.

Such known systems have, however, the disadvantage of allowing electrical signals to be present in close proximity to expose fuel so that, even though these electrical signals are of very low level, the possibility of sparks and ignition of the fuel cannot be totally discounted.

It is an object of the present invention to provide a system in which the presence of such electrical signals is removed altogether from the region of the pump nozzle.

In accordance with the present invention, the vehicle is arranged to transmit optical radiation which is picked up by a fibre-optic whose one end is carried by a pump nozzle, coupled to a fuel pump by way of a fuel delivery conduit, so as to be disposed in a position facing the transmitter when the pump nozzle is inserted into the fuel entry port of the vehicle, and which runs, by way of the fuel pump, to a remote fuel management system which interrogates the fibre optic and processes signals received therefrom, the fibre optic being arranged to be carried within the fuel delivery conduit itself in extending between the pump nozzle and the fuel pump.

Preferably the fibre optic is surrounded by a protective metal sleeve and extends into the fuel delivery conduit via a joint on the pump nozzle.

Advantageously, the metal sleeve in the exposed region of the fibre optic is stainless steel tubing. Where the fibre optic is disposed within the fuel delivery conduit, the metal sleeve can be of a flexible type, e.g. in the form of a flexible helix.

Before the delivery conduit reaches the associated fuel pump, it is necessary to provide a gland through which the fibre optic emerges before travelling on to the fuel management system.

In a preferred embodiment, the fibre optic is run from the top of the nozzle, through a custom designed fitting into the centre of the fuel delivery hose. The fibre optic then runs the length of the delivery hose, surrounded by the fuel product, until it reaches the region of the fuel pump, where it emerges via the gland.

An on-board unit on the vehicle is arranged to transmit a data stream via the optical transmitter (e.g. an L.E.D.) comprising items such as vehicle identity, odometer details, and diagnostic information. In some embodiments, the data stream can be provided continuously and repeatedly, so that it is passed automatically to the fuel management system upon the transmitter and fibre optic being brought into transmissive connection. The data is arranged to be processed by the fuel management system and, if determined to be valid, the fuel pump is energised to allow fuel to be dispensed. Delivery of fuel is terminated as soon as transmissive contact between the transmitter and fibre optic is lost as a result of the fuel nozzle being withdrawn from the vehicle fuel tank.

The data received from the vehicle is processed in a conventional manner by the fuel management system, and can be available to the operator in the form of a fleet report, when requested.

In this manner, there is provided a data monitoring system wherein electrical signals in the region of the pump nozzle are avoided in an ergonomic and elegant but simple manner.

The invention is described further hereinafter, by way of example only, with reference to the accompanying drawings, wherein.

Figure 1:
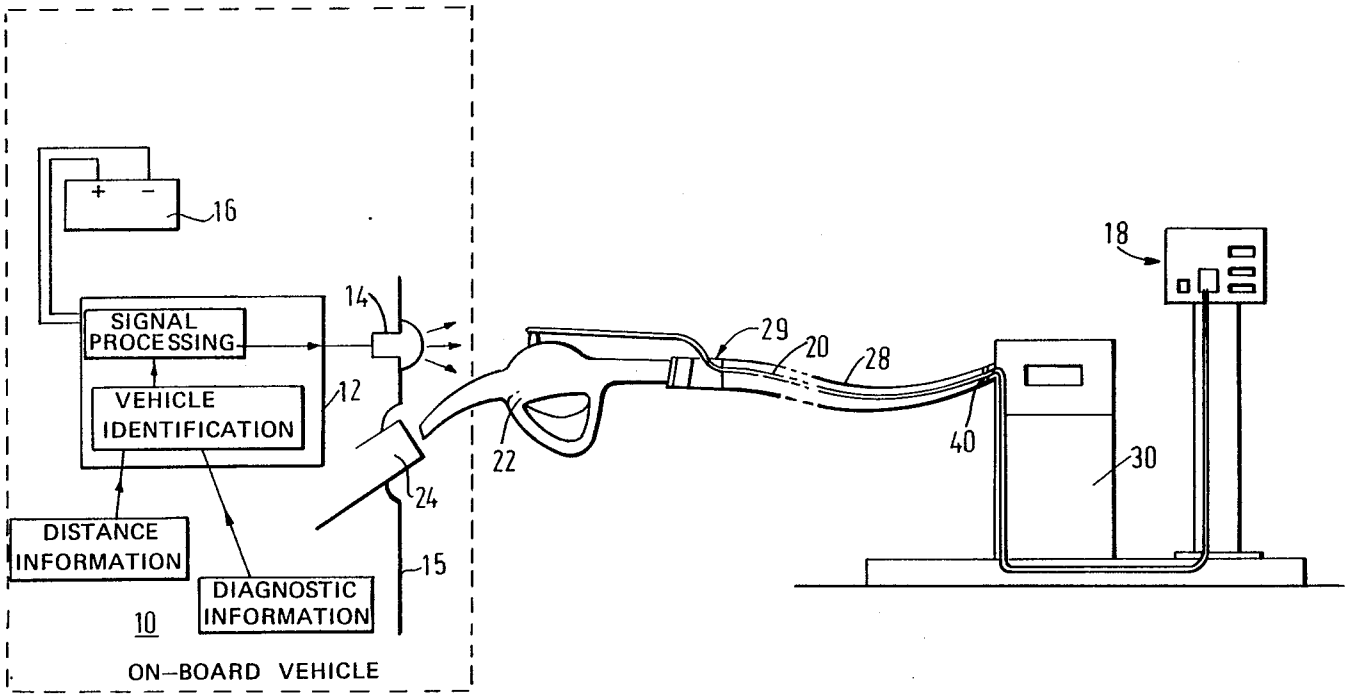
FIG. 1 is a highly diagrammatic representation of one embodiment of a fleet data monitoring system in accordance with the present invention.

On board each of a plurality of vehicles 10 is a data unit 12 which carries a unique vehicle identification which can be transmitted electronically to a transmitter unit in the form of an L.E.D. 14 mounted at a location at or adjacent the exterior of the vehicle body 15. Other information relating, for example, to distance travelled and diagnostic tests, can be supplied to the data unit 12 and hence, in the form of a coded signal, to the transmitter unit 14. The units 12 and 14 are normally powered by the vehicle battery system 16.

Distance information can, for example, be generated by a tachograph (not shown), or by measuring a rotation proportional to distance travelled, i.e. rotation of an odometer drive, drive shaft or road wheel.

Diagnostic information can be obtained from any of a number of sources, such as a plurality of simple on/off alarm signals, oil temperature or pressure sensors, water temperature sensors, light failure sensors, worn disc pads, etc., or from a more sophisticated on-board diagnostic system.

The apparatus also includes a fuel management and/or security system 18 which would normally be located at a fixed location. Information transmitted optically by the L.E.D. 14 is arranged to be picked up by a fibre optic 20 and carried to the fuel management system 18. To achieve this, one end of the fibre optic 20 is mounted on the top of the fuel nozzle 22 so as to lie in a position facing the L.E.D. 14 when the nozzle has been correctly inserted into the fuel entry port 24 on the vehicle 10. The fibre optic 20 is contained within an outer stainless steel sheath and passes at 26 through a specially designed fitting into the centre of the fuel hose 28. The fibre optic 20 then runs the length of the hose 28, surrounded by the fuel product, until it reaches the region of the fuel pump 30. This arrangement provides protection and extra mechanical strength for the fibre optic compared to a situation in which the fibre optic were to be run externally of the hose. In the region of the fuel pump 30 the fibre optic passes out of the fuel hose again by way of a suitable gland 40 (see FIG. 3) and then runs on to reach the fuel management system 18.

In the portion of the fibre optic extending through the flexible hose 28, the surrounding metal sheath can be made correspondingly flexible, for example by use of a helical-type sheathing.

Figure 2:
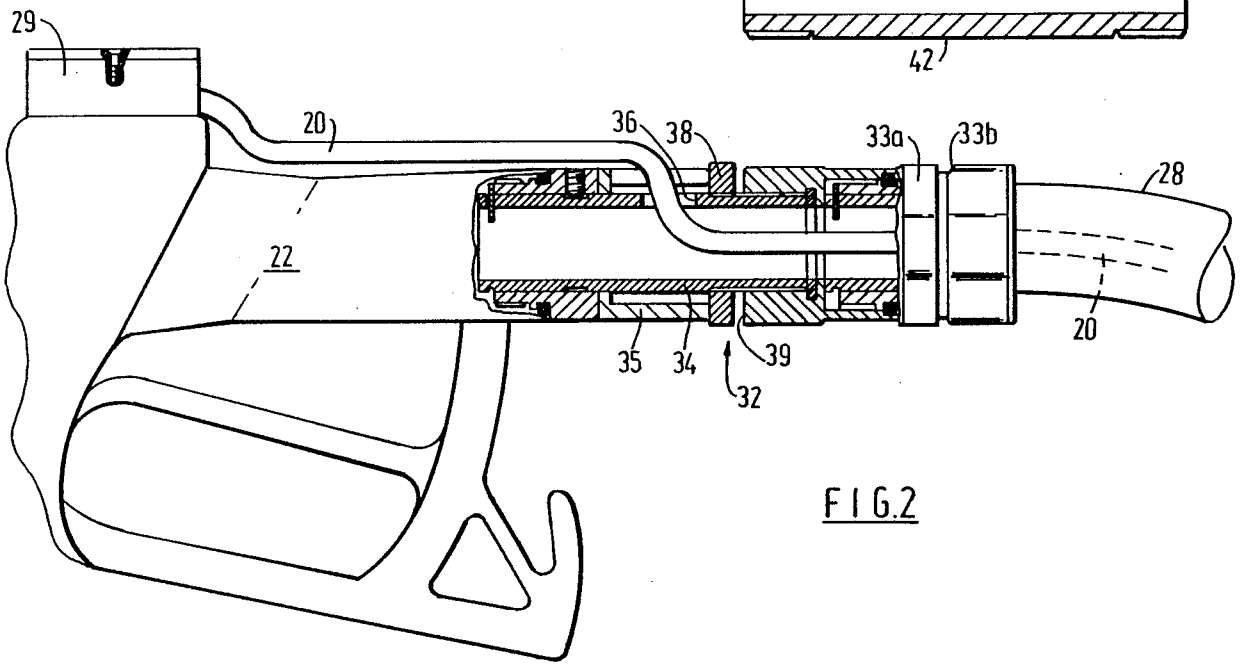
FIG. 2 is a longitudinal section through an adaptor member on the pump nozzle, showing the fibre optic passing therethrough.

FIG. 2 shows one example of an adaptor 32 which can be fitted between the usual nozzle device 22 and the flexible hose 28 to enable the fibre optic to enter the hose. The adaptor 32 is in the form of a metal tube 34, usually stainless steel, the left-hand end of which (as viewed in FIG. 2) is adapted to be fitted to the conventional nozzle 22. The right-hand end of the adaptor receives a swivel device comprising non-rotating swivel components **33*a*,33*b* and a swivel adaptor 39 to which the hose 28 is screw fitted to enable some relative rotation of the pump nozzle and the hose. One end of the fibre optic terminates in a housing 29 fitted rigidly to the top of the nozzle body 22. The fibre-optic 20 passes into the interior of the adaptor 32 by way of an aperture 36 in the wall of the tube 34 and is welded to the wall of the tube 34 at this location (the weld is not shown in FIG. 2). The region around the weld is covered by a protective sleeve 35 held in place by a locking ring 38**.

Figure 3:
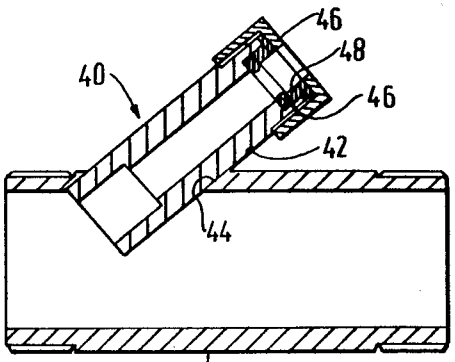
FIG. 3 is a longitudinal section through a gland by which the fibre optic leaves the fuel hose.

FIG. 3 shows the gland 40 in more detail. A metal sleeve connector element 42 is connected at its one end to the hose and its other end to the fuel pump fixture 30. Disposed at an oblique angle to the longitudinal axis of the sleeve element 42 is a tubular metal ferrule holder 42 which is welded or brazed into a correspondingly angled aperture 44 in the holder wall. The outer end of the ferrule holder 42 carries a ferrule cap 46, O-ring top hat 48 and O-ring 46. In use, the ferrule holder 40 receives a ferrule (not shown) fixed on the fibre optic so as to enable the fibre optic to leave the hose in a fluid-tight manner.

Thus, by the aforegoing arrangement, the fibre optic is enabled to pass along the interior of the hose 28 and to emerge in a fluid-tight manner at the two ends of the hose adjacent the fuel pump 30 and fuel nozzle 22, respectively.

Thus, in use, the transmitter 14 on the vehicle is arranged to send coded signals to the management system by way of the fibre optic 20, the coded signals normally including the vehicle identity and the distance and diagnostic information. If the vehicle is determined by the management system to be valid (i.e. to be one to which fuel can be dispensed), the fuel pump 30 is energised and the nozzle is permitted to dispense fuel to the vehicle tank.

During the time that the vehicle is drawing fuel, the diagnostic information is transferred.

When the link between the transmitter 14 and fibre optic 20 is eventually broken by removal of the fuel nozzle from the tank for more than a predetermined timeout, the pump 30 is arranged to be switched off.

The management system 16 can then prepare a transaction report with such items as the data, time, vehicle identity, amount and type of fuel odometer reading and any alarms that have been noted.

The management system 16 subsequently processes the transaction report and updates the vehicle record files. Any reportable items such as low mpg or vehicle alarms are extracted and reported to the fleet operator.

Although the abovedescribed embodiment is able to transmit only in one direction, i.e. from the vehicle to the fuel management system, other embodiments can be arranged to accommodate bi-directional transmissions both from the vehicle to the management system and vice versa. In this case, the infra-red transmitter is replaced by a transmitter/receiver device so that it can also receive light signals emitted from the pump nozzle end of the fibre optic 20.

Bidirectional transmission is useful in that, for example, the management system can be arranged to transmit a coded signal and it is only on receipt of this coded signal that the information is passed back to the management system regarding the vehicle data and fuel requirements, etc.

Thus, for example, upon receipt of the coded signal from the management system 18, the transceiver 14 on the vehicle may be arranged to send a further coded signal back to the management system, comprising the vehicle identity and the distance and diagnostic information. If the vehicle is determined by the management system to be valid (i.e. to be one to which fuel can be dispensed), the fuel pump is switched on and the nozzle is permitted to dispense fuel to the vehicle tank.

During the time that the vehicle is drawing fuel, the diagnostic information can be transferred. During the same period, any alarm indicators, real time clocks and the like, on the vehicle can be reset.

We claim:

1. A data monitoring system for use in the operation of a fleet of commercial vehicles, each vehicle of said fleet having a fuel entry port, said system comprising:

(a) a radiation transmitter adapted to be disposed on each said vehicle at a position external to said fuel entry port;

(b) a fuel supply comprising a fuel pump, a flexible fuel delivery conduit in communication with said fuel pump, a fuel dispensing nozzle in communication with said flexible fuel delivery conduit and an adaptor extending between and connecting the flexible fuel delivery conduit and the fuel dispensing nozzle, said adaptor comprising a metal tube having a first end fitted to the fuel dispensing nozzle and a second end coupled to the flexible fuel delivery conduit by way of a swivel device, said metal tube being disposed such that fuel flowing between the flexible fuel delivery conduit and the fuel dispensing nozzle passes through the metal tube of the adaptor, said metal tube of said adaptor having an aperture extending therethrough;

(c) a fuel management system coupled to said fuel pump for controlling the amount of fuel dispensed via the fuel dispensing nozzle; and (d) a fibre optic member surrounded by a protective metal member and having first and second opposed end portions and an intermediate portion extending through the fuel delivery conduit substantially from the pump to the fuel dispensing nozzle and being generally surrounded by the fuel in the fuel delivery conduit, said first end portion of said fibre optic member emerging from the fuel delivery conduit in proximity to the pump via gland means disposed in the flexible fuel delivery conduit for preventing leakage of the fuel and said first end portion being in communication with the fuel management system for supplying information received from said radiation transmitter to said fuel management system, the second end portion of said fibre optic member energing from the metal tube of the adaptor in proximity to said fuel dispensing nozzle, said second end portion of said fibre optic member extending through the aperture in the metal tube of the adaptor and being carried by the fuel dispensing nozzle at a location thereon for receiving information from the radiation transmitter upon insertion of the nozzle into the fuel entry port of the vehicle.

2. A system as claimed in claim 1, wherein the metal member surrounding the fibre optic member is in the form of a rigid metal sleeve which is welded to the metal tube of the adaptor where it passes through the aperture therein.

3. A system as claimed in claim 2, wherein a region around the weld of the metal sleeve to the metal tube of the adaptor is covered by a second protective member held in place around the metal tube by means of a locking ring.

4. A system as claimed in claim 3 wherein at least portions of the metal protective member around the fibre optic member which pass through said aperture of said metal tube is made of stainless steel.

5. A system as in claim 1 wherein the radiation transmitter is disposed above the fuel entry port and wherein the second end of said fibre optic member is mounted to a top portion of the nozzle.

6. A system as in claim 1 wherein the protective metal member surrounding the fibre optic member is a protective sheath.

7. A system as in claim 1 wherein the protective metal member surrounding the fibre optic member is a protective sleeve.

* * * * *

UNITED STATES PATENT AND TRADEMARK OFFICE

CERTIFICATE OF CORRECTION

PATENT NO. : 4,934,419

DATED : June 19, 1990

INVENTOR(S) : Iain A.J. Lamont and Stuart D. Finch

It is certified that error appears in the above—identified patent and that said Letters Patent is hereby corrected as shown below:

On the title page, after the application filing data, insert:

--FOREIGN APPLICATION PRIORITY DATA

June 30, 1988 [GB] United Kingdom....8815584.1--.

Signed and Sealed this

Twenty-fifth Day of June, 1991

*Attest:*

*Attesting Officer*

HARRY F. MANBECK, JR.

*Commissioner of Patents and Trademarks*